United States Patent [19]

Schwartz

[11] 4,121,237

[45] Oct. 17, 1978

[54] METHOD AND APPARATUS FOR PROCESSING PHOTOGRAPHIC FILM

[75] Inventor: Theodore F. Schwartz, Scottsdale, Ariz.

[73] Assignee: The Scott & Fetzer Company, Fort Wayne, Ind.

[21] Appl. No.: 761,434

[22] Filed: Jan. 21, 1977

[51] Int. Cl.[2] ..... G03D 3/04

[52] U.S. Cl. ..... 354/323; 354/324; 354/328

[58] Field of Search ..... 354/297, 304, 305, 317, 354/323, 328, 299; 118/612; 259/72, 185; 366/241, 349

[56] References Cited

U.S. PATENT DOCUMENTS

| | | | |
|---|---|---|---|
| 2,797,625 | 7/1957 | Fairbank | 354/303 |
| 3,575,099 | 4/1971 | Levenson et al. | 354/328 |
| 3,611,903 | 10/1971 | Green | 354/328 |
| 3,985,437 | 10/1976 | Kuehnle | 354/304 |

*Primary Examiner*—L. T. Hix
*Assistant Examiner*—Alan Mathews
*Attorney, Agent, or Firm*—Ronald D. Welch

[57] ABSTRACT

A photographic film developing process and apparatus incorporating a processing chamber in which a resilient membrane forms one wall of the chamber. A photographically sensitized exposure is positioned within the chamber with its emulsion surface disposed in close juxtaposition to the membrane. The constituent components of photographic processing chemistry for the emulsion are sequentially introduced to the chamber and, simultaneously, the membrane is cyclically deformed to provide application and agitation of the processing chemistry.

13 Claims, 6 Drawing Figures

METHOD AND APPARATUS FOR PROCESSING PHOTOGRAPHIC FILM

BACKGROUND OF THE INVENTION

1. Field of the Invention

The present invention relates to photographic film developing processes and processors and in particular, to such a process and apparatus incorporating a resilient membrane in close proximity to a photographically sensitized material for effecting uniform application and agitation of a minimum amount of developing chemistry.

2. Description of the Prior Art

Film processing or developing is typically performed by batch processing. In the simplest form, batch processing is performed utilizing a plurality of tanks containing the individual components of chemistry for processing or developing a particular film or photographic emulsion or simply, photographs, and the photographic exposures are passed in succession through the various components.

In commercial applications, such processing is typically performed in large batch processing machines containing a large quantity of the processing chemistry, an elaborate film transport mechanism, and associated control equipment for maintaining concentration, temperature, speed and the like.

These processes and processors are inherently sensitive, and substantial variations in the final product can be caused by changes such as temperature, aging, and normal degeneration of the chemicals as they are used and reused to develop quantities of photographs.

In large commercial applications, the cost of such processing equipment and the required manpower for operating and maintaining the equipment in proper working condition can be justified.

However, there are many situations in which it is desirable to process or develop photographs in quantities of one or a few exposures at a time. Such applications include installations for producing photographic identification cards and drivers licenses, processing of x-rays, and production of photographic "reprints". Inherent in such applications is the desire, and often the need, to process the film in a relatively short period of time. In some applications, the self developing or "instant print" such as manufactured by the Poloroid Corporation and Eastman Kodak have been used. Nonetheless, in view of the diverse applications, expense, and inherent limitations of such instant print films, there still exists a need for a wet process processor and method adaptable for use with a wide variety of photographic emulsions which is capable of processing one or a few exposures at a time.

The success of prior art processors for satisfying this need has been limited for a number of reasons. For example, such processors have incorporated processing tanks containing a sufficient amount of chemistry to process a considerable number of photographic exposures. The chemistry in turn ages, and degenerates as it is used and reused to process the exposures. The need to accellerate the developing process by means such as heating further hastens degeneration of the processing chemistry. The processors are relatively large and bulky, and the use of multiple tanks limits adaptability to process different types of photographic emulsions utilizing diffrent processing chemistry due to the need to alter the developing time, the number of tanks, and the like.

To obviate such problems, it has been considered desirable to provide a film process and processor that utilizes a quantity of developing chemistry sufficient to process only the number of photographic exposures to be processed, typically but not necessarily one, and then simply discard the used chemistry. It is further desirable to have such a process and processor in which the quantity of developing chemistry required is relatively small such that it can be heated quickly at the time it is to be used thereby permitting bulk storage chemistry for the system to be maintained at reduced temperatures. It is further desirable to have such a process and processor which effects uniform and complete agitation of the chemistry without mechanical contact and therefore damage to the photographic emulsion and to provide a method and means for agitation of the processing chemistry which is effective on very small quantities thereof. It is further desirable to have such a process and processor which can be adapted for use with different photographic emulsions and developing chemistry.

It is therefore an object of the invention to provide an improved film process and processor.

It is another object of the invention to provide such a process and processor which effects single usage of the developing chemistry.

Still another object of the invention is to provide such a process and processor in which development can be accurately controlled.

Yet another object of the invention is to provide such a process and processor which facilitates accellerated processing without detremental effects to the photo sensitive material.

Yet another object of the invention is to provide such a process and processor which effects uniform and complete application of the developing chemistry to the photographic exposures therein without damage to the photographic emulsion.

Still another object of the invention is to provide such a process and processor which incorporates a single processing chamber for application of all the components of the developing chemistry to the sensitized emulsion.

Another object of the invention is to provide a processor having such a processing chamber of minimal volume.

Yet another object of the invention is to provide such a process and processor which can be easily adapted for processing different types of photographic emulsions utilizing different processing chemistry.

Another object of the invention is to provide such a processor which effects uniform and complete application of small quantities of processing chemistry to a photographic emulsion without damage thereto.

Still another object of the invention is to provide a process and processor in which the developing chemistry is agitated through the medium of a flexible membrane interposed between the sensitized emulsion and the agitating mechanism.

Yet another object of the invention is to provide such a process and processor wherein agitation of the chemistry is performed without contact of the agitating mmechanism with the sensitized emulsion.

SUMMARY OF THE INVENTION

A film process and processor is provided, which incorporates a processing chamber wherein one wall of the chamber is a resilient membrane. The chamber itself has a volume to contain, in sequence, a quantity of each the components of the developing chemistry sufficient to develop only the number of photographic exposures contained within the chamber. Means are provided for supporting the photographic exposures in the chamber with the sensitized emulsion surface thereof disposed in close but spaced, juxtaposition to the membrane. Means are provided for deforming or otherwise massaging the membrane to effect uniform application and agitation of the chemistry to the emulsion surface of the exposures, and means are provided for introducing and removing the component parts of the developing chemistry into and from the chamber in timed sequence.

BRIEF DESCRIPTION OF THE DRAWINGS

The objects, features, and advantages of the invention will be apparent from the following description of a specific embodiment of the invention, as illustrated in the accompanying drawings, wherein.

DESCRIPTION OF A SPECIFIC EMBODIMENT

Figure 1:
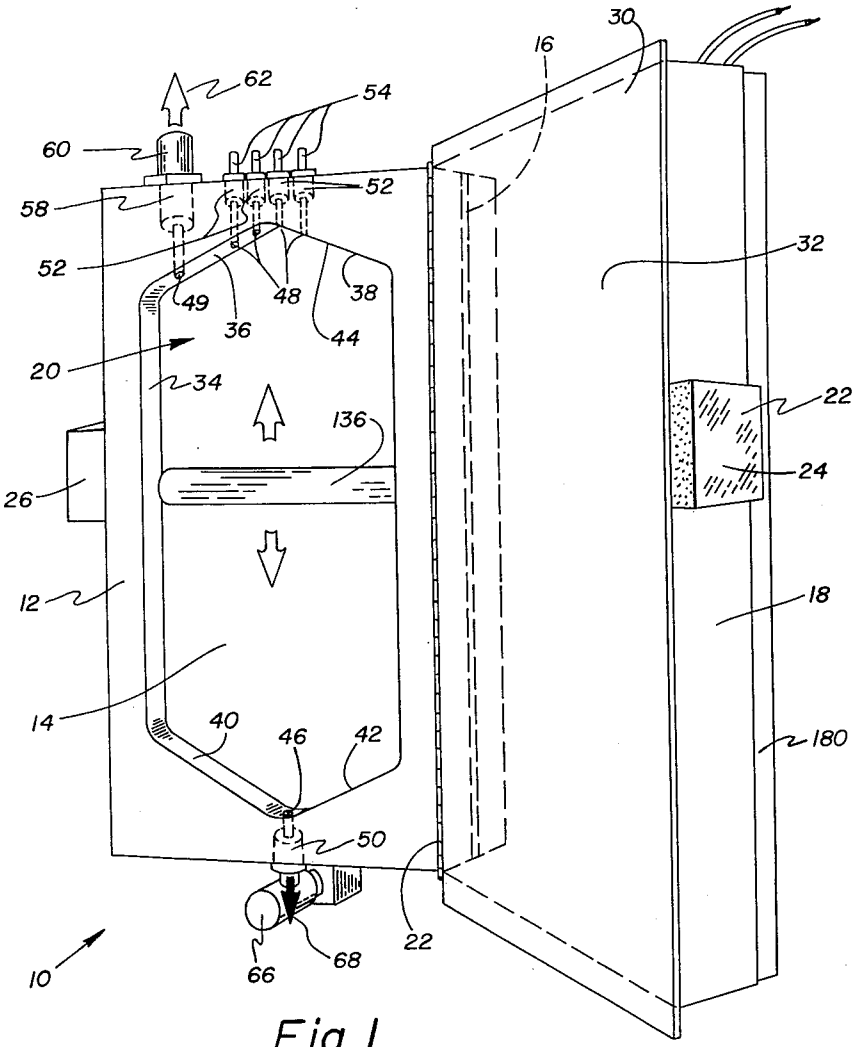
FIG. 1 is a perspective view illustrating details of the processing chamber of the present invention.

Referring now to the drawings, there is shown in FIG. 1 a processing chamber assembly 10 in accordance with the present invention. Chamber 10 comprises generally a perimeteral wall section 12, a membrane 14, membrane retainer 16 and a closure panel 18. Combined, wall section 12, diaphragm 14, and a closure panel 18 define a processing chamber 20, chamber 20 having a relatively shallow depth dimension perpendicular to the surface of diaphragm 14.

Figure 2:
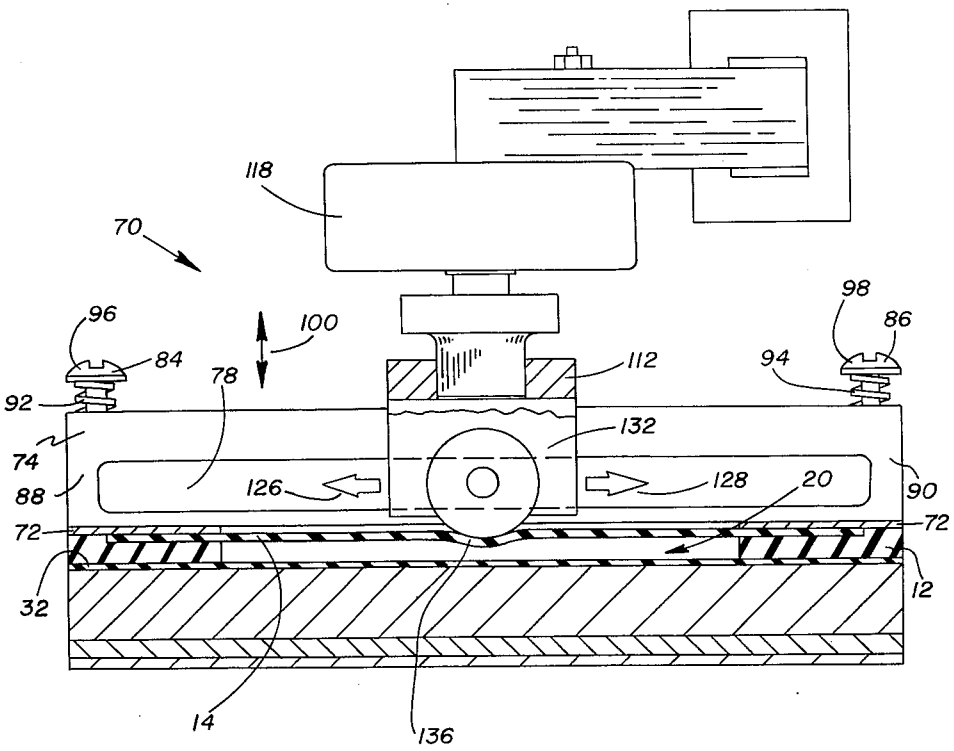
FIG. 2 is a sectional view of the process chamber for use in the present invention.
Figure 3:
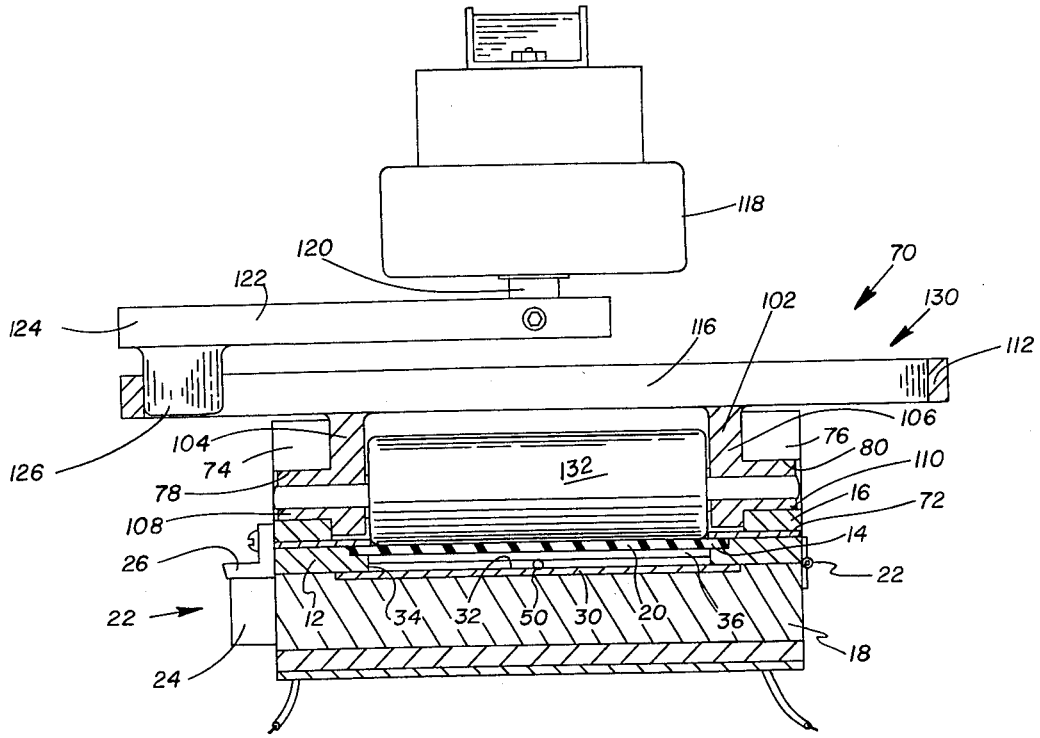
FIG. 3 is a top sectional view of a processor chamber in accordance with the present invention.
Figure 4:
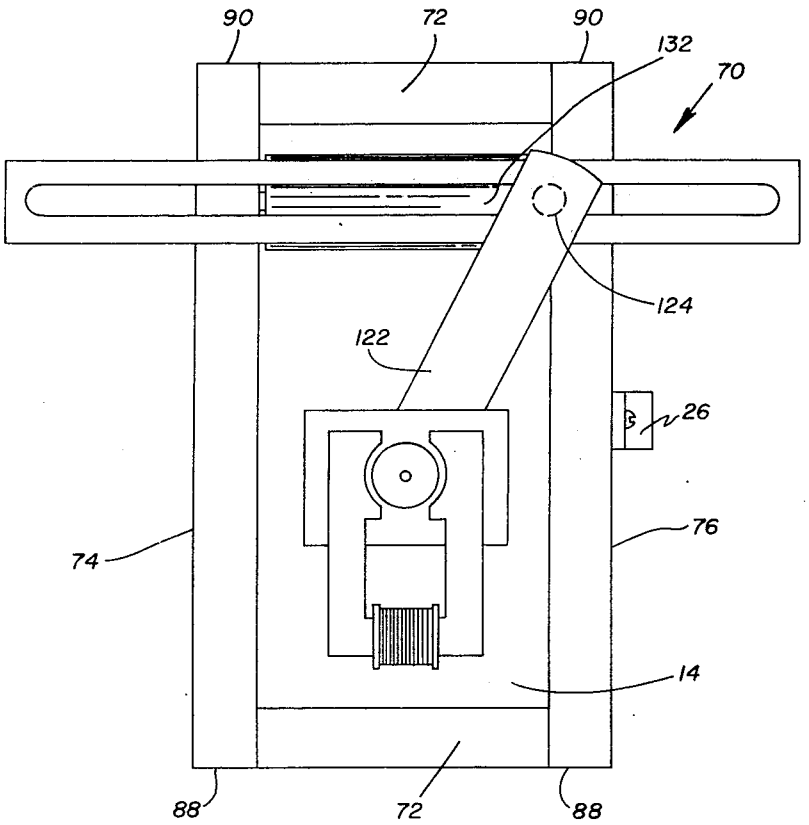
FIG. 4 is an end plan view of a processor chamber in accordance with the present invention as viewed from the agitator side thereof.

Closure wall 18 may, in the embodiment illustrated in FIGS. 1 through 4, be pivotally mounted to wall section 14 by means of a hinge 22 such that it can be moved between an open position, shown in FIG. 1, and a closed position as shown in FIGS. 2, 3, and 4. Means such as a magnetic latch 22 comprising a magnet 24 fixedly secured to closure panel 18 and a metallic element 26 fixedly secured to wall section 12 are provided to maintain closure panel 18 in its closed position while permitting opening thereof.

A photographic exposure 30 is positioned between wall section 12 and a closure panel 18 with its emulsion surface 32 disposed toward membrane 14 when the closure member 18 is in its closed position. Exposure 30 is maintained in position by the clamping action between the closure wall 18 and wall section 12 and, due to the pressure therebetween, a fluid tight seal is maintained therebetween.

It will be observed that the perimeteral wall 34 of chamber 20 is provided with angled upper and lower end portions 36, 38, 40, and 42, respectively, meeting in apeces 44, 46, respectively.

A plurality of fluid inlet ports 48 are formed through wall section 12 in a direction generally parallel to the surface of diaphragm 14 and adjacent apex 44.

A fluid vent 49 is also provided in wall section 36, vent 49 again extending through wall section 18 generally parallel to the surface of diaphragm 14, and fluid discharge port 50 is provided through wall section 12 adjacent apex 46 of perimeteral wall 34.

Inlet ports 49 are provided with enlarged threaded sections 52 to which are fitted inlet fittings 54. Each inlet fitting 54 is preferably provided with a conventional unidirectional valve therein (not shown) which permits fluid to pass therethrough into chamber 20 while preventing fluid from flowing backwardly therethrough. Similarly, vent 49 is provided with an enlarged threaded portion 58 into which is fitted a unidirectional valve 60, valve 60 permitting flow outwardly from chamber 20 as indicated by arrow 62 and preventing flow inwardly thereto. Threadedly attached to outlet port 50 is a suitable flow control valve 66 which may be for example, an electrically or pneumatically operated valve whereby, a valve 66 is capable of selectively controlling the flow of fluid outwardly through port 60 as indicated by arrow 68.

Thus configured, the photographic exposure 30 can be placed between wall section 12 and closure panel 18 and firmly secured in that position by closing closure panel 18. This in turn clamps the photographic exposure 30 in a position with its emulsion surface 32 facing and closely juxtaposed with respect to the flexible membrane 14.

Referring now particularly to FIGS. 2, 3, and 4, there is illustrated the membrane deforming or massaging means 70. Membrane 14, itself, is maintained in position by means of a suitable retainer plate 72 which is fixedly secured to wall section 12 by means such as threaded fasteners, glue, or the like (not shown). The membrane massaging means 70 includes a pair of laterally (as viewed in FIGS. 1 and 3) disposed track members 74, 76. Members 74, 76, extend substantially the length of chamber 10 and are provided with longitudinally extending slots 78, 80, respectively. Track members 74, 76 are secured to retaining plate 72 by means of elonagated threaded fasteners 84, 86 which are slideably received through the distal ends 88, 90 of track members 74, 76. Compression springs 92, 94 are interposed between the enlarged heads 96, 98 of fasteners 84, 86 and the adjacent surfaces of track members 74, 76 whereby the track member may move in a direction generally perpendicular to membrane 14 as indicated by arrow 100 for a purpose to be explained below.

A slide member 102 is provided, member 102 including a pair of downwardly (as viewed in FIG. 3) extending legs 104, 106 laterally spaced apart such that they may be slideably received between the track members 74, 76. Legs 104, 106 further include outwardly extending slide portions 108, 110 of generally rectangular cross-sections, guide portions 108, 110 being slideably received in the slots 78, 80.

Legs 104, 106 are fixedly joined together by a transversely extending member 112, member 112 extending laterally between and beyond legs 104, 106.

As can best be seen in FIG. 4, member 12 is provided with an elongated cam slot 116 extending substantially the length thereof. A drive means such as a small electric gear motor 118 is mounted adjacent chamber 10 by a suitable frame (not shown) and includes an output shaft 120 having an axis that extends perpendicular to the intersects membrane 14 at about its center. A crank arm 122 is fixedly secured to output shaft 120 for rotation therewith. The distal end 145 of crank arm 122 is provided with a cylinderical cam element 126 which is slideably received within a slot 116. Thus configured, it will be seen that rotation of crank arm 122 by motor 118 will effect a cyclical oscillation of member 112 etc. as indicated by arrow 126, 128.

Rotateably mounted in slide member 102 is a roller 132. Roller 132 may be fabricated of any suitable material such as rubber, plastic or the like. Roller 132 has a lateral dimension (as viewed in FIG. 3) somewhat smaller than the lateral dimension of chamber 20 and has a diameter such that it engages and deforms membrane 14 toward closure member 18. It will be seen that as member 102 oscillates, as indicated by arrows 126, 128, roller 132 will be caused to massage and deform the membrane 14 as indicated at 136.

Deformation of membrane 14 by roller 132 should bring membrane 14 in to close proximity to the photograph 30. Preferably, membrane 14 should not physically contact photograph 30, however, contact therebetween can be permitted if movement of the membrane is perpendicular to the surface of the photograph and lateral movement that could effect a scrubbing action is avoided.

Figure 5:
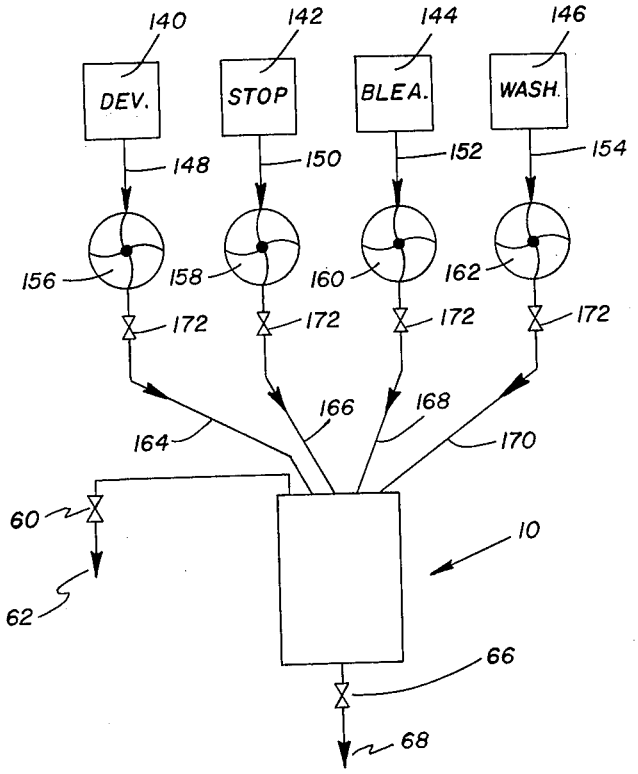
FIG. 5 is a block diagram illustrating flow of the developing chemistry to the processor.
Figure 6:
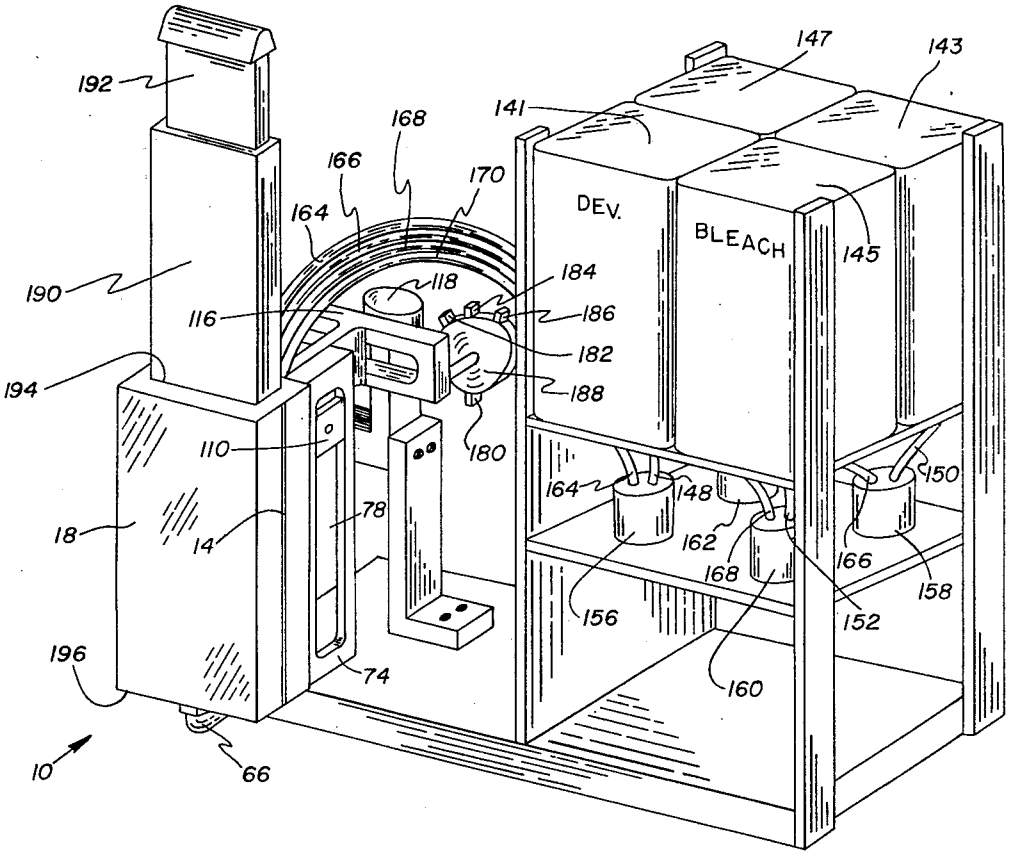
FIG. 6 is a perspective view of a typical processor unit with the cover thereof removed.

Referring now to FIGS. 5 and 6, the processor is illustrated as utilizing a four step process. It will, however, be obvious to those skilled in the art that different processes utilizing different components and numbers thereof could be used. The four component parts of the developing chemistry as illustrated include a developer solution 140, a stop solution 142, a bleach solution 144, and a wash solution 146, stored in suitable containers 141, 143, 145, 147, respectively, these four components 140, 142, 144, and 146 are applied to a photographic emulsion in sequence to effect development. Typical of such a four step developing process and associated emulsion is P-25, positive print film and processing chemistry manufactured by Ciba Giegie, the film being a positive color print emulsion. That is, this particular emulsion will produce a fully developed positive print of the exposure in response to the four step developing chemistry.

Each of the containers is in turn connected by a suitable conduit 148, 150, 152, and 154, respectively, to a suitable intermittently operable pump 156, 158, 160, 162, respectively. It should be observed that each of the conduits 148, through 154 could be connected to a common pump. However, it is preferred to use separate pumps to reduce contamination and interaction between the various chemistry components. Each of the pumps 156 through 162 in turn is connected to a respective one of the inlet ports 56 of manifold 54 via conduits 164, 166, 168, and 170 and the components 140, 142, 144, 146 of the developing chemistry are passed thereby into the chamber 20 in response to the operation of the individual pumps 156.

As can be seen in FIG. 6, control of the pumps 156, 158, 160, 162 can be effected by a plurality of conventional switches or the like 180, 182, 184, 186 which in turn are operated via a cam mechanism 188 operatively coupled to gear motor 118 for operation at reduced speed and at a predetermined time relationship with respect to the membrane deforming mechanism 70. By proper selection of the speed of rotation of the cam mechanism 188, motor speed, spacing and position of the switches 180, 182, 184, and 186, pumps 156, 158, 160 and 162 can be caused to operate for any desired period of time in any desired sequence, and for predetermined time intervals. Thus, it will be seen that the quantity of each of the components of the developing chemistry delivered to the chamber 20 can be easily controlled, the time for which each of the components 140, 142, 144, and 146 remain in the chamber can be similarly controlled by a similar operation of valve 56, i.e. by means of an electrical switch operated by cam mechanism 188. Valve 56 being closed when the chamber is being filled and opened to discharge a used chemistry component. Further, when the chamber 20 is being filled, valve 60 will vent air from chamber 20. In the alternative, valve 56 may be bidirectional flow valve controlled by another switch (not shown) operated by cam mechanism 188 to permit venting from chamber 20 when the later is being filled, and venting into the chamber when it is being evacuated.

Still referring to FIG. 6, the processing chamber 10 is illustrated in an alternative embodiment wherein the closure panel 18 is fixedly secured in position and film is inserted into the chamber 20 via a septum device 190. Such a septum device is disclosed in my corresponding U.S. Pat. application, Ser. No. 883,799 and assigned to the same assignee as the present invention. The septum device 190 extracts an exposed photographic emulsion from a camera, retains same in a light-tight compartment and then my means of a suitable ejector slide 192, ejects the emulsion into a processor as herein described.

Similarly, the chamber assembly 10 is provided with a receptacle 194 complementary to the septum at 190, receptacle 194 being provided with a light trap (not shown) to maintain a light-tight enclosure. When processing of the emulsion is completed, the emulsion can be either withdrawn back into the septum 190 to remove same from the chamber or it can be ejected from the lower end 196 by any suitable mechanism, such mechanisms being well known to those skilled in the art.

In operation, a photographic exposure 30 is first placed into the chamber means 10 as above described. Next, in sequence, the components 140 through 146 are pumped into the chamber 20. Simultaneously, roller 132 is oscillated or reciprocated as above described thereby providing uniform application and agitation of the chemistry to the photographic emulsion 32. At the completion of each step of the processing, i.e. developing, stopping, bleaching, and washing, the respective one of components 140 through 146 is evacuated from the chamber 20 via valve 66 and port 50. These chemicals are simply discarded into a collection tank for disposal, this discharge being facilitated by the action of the diaphragm.

It should further be observed that as the individual components are injected into and discharged from the chamber 20, air is evacuated from and admitted to the chamber 20 via vent 49 and stop valve 60 whereby the chamber can be filled with the respective components.

In may applications, it is desirable to heat the components 140 through 146 during processing. In prior art devices this has been effected by heating large quantities of the components in relatively large tanks. This in turn causes serious degeneration of the chemicals over a period of time along with inherent and undesirable effects such as oders, fumes, and corrosion to the mechanism of the processor. In the present invention, however, heating can be applied to the chamber only such as by an electric "blanket" heater 180 which may be adhered to the external surface of closure member 18 by means of a "preheater" (not shown) or the like as desired. In such an embodiment, it will be observed that heat is applied only to the developing chamber itself or to the chemistry only at about the time it is to be used and therefore only to the chemicals utilized to develop a single exposure. In such a configuration, the supply of components 140 through 146 can be maintained at room or even reduced temperature to preserve same while at the sametime acceleration of the developing process can be effected by heating of the chamber and/or the chemicals therein.

It will be apparent in view of the above disclosure that various modifications can be effected in the process and processor of the present invention without departing from the scope thereof. For example, rather than providing a closure panel 18 which permits opening of the chamber 20 or a system 90 for transfer of exposures from a camera, the chamber 10 can be provided with inlet and exit slots, the slots being provided with appropriate seals to prevent the egress of fluid therefrom while permitting film to be inserted into the chamber 10. Such seals should, of course, be provided such that they will not damage the emulsion as the film is placed into the chamber 10. This can be effected, for example, by providing rollers of resilient material. The film can be supplied from a continuous magazine or directly from a camera and magazine associated with the processor with individual exposures being cut therefrom upon completion of the developing process. Similarly, while the above invention has been described in conjunction with the use of a particular positive print color photographic emulsion utilizing a four step developing process, it would be obvious that any wet process can be utilized with the present invention. For example, the processing chamber can be utilized with conventional "black and white" negative film developing processes, other positive print black and white and color processes, x-ray exposures and the like by simply substituting the appropriate components of the chemistry in place of components 140 through 146 and providing the required number of pumps and conduits to feed the components one at a time in sequence into the chamber 10. Timing of the process can be effected by simple electrical, electrical-mechanical timers such as cam mechanism 188, clutches, or solid state electronic devices, or other well known means to provide intermittent and timed application of the chemistry to the chamber 10. Such devices are ancillary to the present invention and it will become apparent to those skiled in the art that there are many alternative and well known devices available to perform these functions.

It will further be observed that, while the present invention has been described as utilizing a roller 132 for performing the massaging or deforming function to the reverse side of membrane 14, a wide variety of means could be utilized for this purpose. For example, a simple protruding tab could be substituted for the roller 132 the only requirement being that the tab be made of a lubricious material that does not adhere significantly to the diaphragm 14 or cause pulling and linear distortion thereof. Multiple rollers and multiple tabs could also be utilized.

In the alternative, while volumetric problems of the chamber are more difficult, it is also contemplated within the scope of the present invention that the membrane can be oscillated in a direction perpendicular to the plane of emulsion 32 to provide agitation.

It is desirable to maintain the volume of the chamber 20 at a minimum, that is, of a volume sufficient to contain in sequence enough of each of the components of the developing chemistry required to develop a single exposure. This permits single usage of the chemistry after which time it can be disposed of without loss or waste. In a working embodiment of the invention, it has been found desirable to maintain the small dimension of the chamber at about one-eighth of an inch with dimensions between one-sixteenth and one-fourth inch being satisfactory. It is desirable that the deformed membrane portion 136 not actually contact the surface or emulsion 32. This is, however, not mandatory and contact with light pressure therebetween is permissable if the movement is vertical with respect to the emulsion and so long as the material from which membrane 14 has manufactured does not adhere to or otherwise stick to the emulsion surface when the same is being processed.

In a working embodiment of the invention it has also been found desirable to maintain the speed of oscillation of the roller 132 at between 10 and 100 cycles per minute. Oscillation or massaging of the membrane 14 at speeds greater than this can create turbulance or the like in the chamber 20 with corresponding degeneration or nonuniform development of the exposure. Similarly, oscillation at speeds below 10 cycles per minute may not provide sufficient agitation and mixing of the chemistry to effect uniform development of the exposure.

It will further be apparent to those skilled in the art that the entire chamber means 10 should preferrably be manufactured from a chemically inert material, that is, from a material that does not chemically react with the components of the developing chemistry, many materials being suitable for this purpose. Similarly, the only requirements for the material of membrane 14 is that it be resilient and chemically inert with the developing chemistry. In the above described embodiment of the invention utilizing the positive print color film manufactured by Ciba Giegie, gum rubber of a thickness of about one-eighth inch has been found highly suitable.

While there have been described above the principles of this invention in connection with specific apparatus, it is to be clearly understood that this description is made only by way of example and not as a limitation to the scope of the invention.

What is claimed is:

1. A photographic film processor comprising: a processing chamber including a peripheral wall, a resilient membrane forming another wall of said chamber, means for removably supporting a photographic exposure against said peripheral wall with the emulsion surface thereof disposed in parallel and closely spaced apart relationship to said membrane and closing said chamber, means for introducing and removing photographic processing chemistry components into and from said chamber individually and in sequence, and means for repetitively deforming said membrane to thereby agitate said chemistry components when in said chamber and develop said photographic exposure.

2. The processor of claim 1 wherein the volume of said chamber is substantially equal to the volume of each of said components required to develop a single said photographic exposure, the dimension of said chamber perpendicular to said membrane being substantially smaller than the perimeteral dimension thereof.

3. The processor of claim 1 wherein said deforming means includes means for cyclically flexing said membrane in a direction perpendicular to said emulsion surface.

4. The processor of claim 3 wherein said chamber has a length and a width dimension, said deforming means including a deforming element movable in a direction longitudinally with respect to said emulsion, said deforming element contacting said membrane substantially along a line perpendicular to said length dimension.

5. The processor of claim 4 wherein said deforming element is a roller having its axis disposed substantially parallel to said membrane and perpendicular to said longitudinal dimension.

6. The processor of claim 1 wherein said membrane is formed from a sheet of resilient material.

7. The processor of claim 6 wherein said resilient material is gum rubber.

8. A method of processing film comprising the steps of: placing a photographic exposure in close juxtaposition to a membrane to form a closed chamber, sequentially filling said chamber with individual ones of the components of photographic processing chemistry compatible with the emulsion of said photographic exposure, and simultaneously deforming said membrane along a line parallel to the surface of said exposure and in a direction toward said exposure and cyclically moving said line of deformation orthogonally with respect thereto to thereby uniformly apply and agitate said components and develop said emulsion.

9. The process of claim 8 further including maintaining a space between said membrane and said emulsion to thereby obviate damage to said emulsion.

10. The process of claim 8 further including the step of heating said components simultaneously with said filling and deforming steps to thereby accellerate said developing process.

11. The process of claim 1 wherein said cyclical deforming step is repeated at a rate of between 10 and 100 cycles per minute.

12. The process of claim 8 further including the step of timing the period for which each of said chemistry components remains in said chamber.

13. The processor of claim 1 wherein said means for introducing and removing said photographic processing chemistry includes at least one fluid port communicating with said chamber through said peripheral wall, a plurality of fluid control valves fluidly connected in series between said fluid port and individual ones of a plurality of photographic chemistry reservoirs, timing means for sequentially opening individual ones of said fluid control valves to thereby sequentially introduce individual ones of said photographic chemistry components into said chamber, and at least one fluid exhaust port communicating with said chamber through said peripheral wall and including a fluid exhaust control valve connected thereto, said fluid control valve being operatively coupled to said timing means for operating said last mentioned valve in predetermined time sequence with respect to the operation of said fluid inlet control valves.

* * * * *